US006508470B1

(12) United States Patent
Yuan

(10) Patent No.: US 6,508,470 B1
(45) Date of Patent: Jan. 21, 2003

(54) CASINO CARD GAME

(76) Inventor: Tsuan Yuan, 4628 Nolan La., Las Vegas, NV (US) 89107

( * ) Notice: Subject to any disclaimer, the term of this patent is extended or adjusted under 35 U.S.C. 154(b) by 0 days.

(21) Appl. No.: 09/534,250

(22) Filed: Mar. 23, 2000

Related U.S. Application Data

(63) Continuation-in-part of application No. 09/157,961, filed on Sep. 21, 1998, now abandoned.

(51) Int. Cl.[7] ..... A63F 1/00; A63F 9/20
(52) U.S. Cl. ..... 273/292; 273/138.1
(58) Field of Search ..... 273/292, 274, 273/138.1

(56) References Cited

U.S. PATENT DOCUMENTS 5,248,142 A * 9/1993 Breeding ..... 273/138 R
5,584,486 A * 12/1996 Franklin ..... 273/292
5,607,162 A * 3/1997 Boylan et al. ..... 273/292
5,653,444 A * 8/1997 Dahl ..... 273/274
5,678,821 A * 10/1997 Hedman ..... 273/292
5,810,354 A * 9/1998 Banyai ..... 273/274
5,863,042 A * 1/1999 Lo ..... 273/292
5,988,643 A * 11/1999 Awada ..... 273/292
6,334,613 B1 * 1/2002 Yoseloff ..... 273/274

* cited by examiner

*Primary Examiner*—Valencia Martin-Wallace
*Assistant Examiner*—Alex F. R. P. Rada, II
(74) *Attorney, Agent, or Firm*—Robert Ryan Morishita; Anderson & Morishita

(57) ABSTRACT

A card game begins with players making a single wager. Five cards are dealt to a banker and each player. If a player has a predetermined poker hand, the player plays his poker hand against the banker's five cards. The player's game terminates and the player loses if the banker has a higher ranking poker hand; conversely, the player's game terminates and the player wins if the player has a higher ranking poker hand. If the player does not have a predetermined poker hand, the player and banker arrange their cards into two component hands and compare the hands. The banker rewards the player if both the player's hands outrank the corresponding banker's hands and collects the player's wager if both of the banker's hands outrank or tie the player's corresponding hands. The banker and player push if only one of the player's hands outranks the corresponding banker's hand.

5 Claims, 2 Drawing Sheets

CASINO CARD GAME

Related Application Data

The present application is a continuation-in-part of application Ser. No. 09/157,961 filed Sep. 21, 1998 and abandoned Apr. 21, 2000.

FIELD OF THE INVENTION

The present invention relates to gaming games. Specifically, the present invention is a casino card game based on Pai Gow providing a simple ranking system and a simple bonus system.

BACKGROUND OF THE INVENTION

Pai Gow is a well known gambling game which originated in China and is played with a set of thirty two tiles. Each tile includes a number of pips which indicate the rank of the tile. For reasons of tradition, the rank of the tile is not directly related to the number of pips on the tile. For example, a tile with twelve pips is the highest ranking tile; a tile with three pips is the lowest ranking tile.

A game of Pai Gow begins with the players making a wager. Tile hands are distributed to the players and each player organizes his or her tiles into a high hand and a low hand with each hand having two tiles. The low hand must have a lower ranking than the high hand according to the well known ranking of Pai Gow tiles. The dealer likewise organizes his or her tiles into high and low hands.

Wagers are resolved by comparing the rank of the player's high hand and low hand to the dealer's high hand and low hand, respectively. If both the player's high and low hands outrank the dealer's high and low hands, the player wins and is payed even money, less a five percent commission to the casino. If the dealer's high and low hands outrank the player's high and low hands, the dealer collects the player's wager. If one, but not both, of the player's hands outrank the one of the dealer's hands, the game is a push and the wager is neither collected nor paid.

A drawback of Pai Gow is that the rankings are complicated. Thus, Pai Gow is a game that only experienced players can play quickly. To address this problem simplified games have been created, such as Pai Gow Poker, that use simpler or better known ranking systems, such as conventional poker rankings.

In Pai Gow Poker, seven cards are dealt to the banker and the players. The banker and players arrange the cards into a five-card high hand and a two-card low hand. Each player compares his or her high hand to the banker's high hand and his or her low hand to the banker's low hand. The player wins if both hands outrank the corresponding banker's hands according to conventional poker rankings. If one of the player's hands outranks one of the banker's hands, and the other banker's hand ties or outranks the other player hand, the player and banker "push" and the player neither wins nor loses his wager. If both the banker's hands outrank or tie the player's hands, the player loses his or her wager.

It is also well known in the art that one feature attractive to players is a bonus. One drawback of conventional Pai Gow Poker is that there is no large bonus or jackpot available. In response, jackpot features, such as that disclosed in Franklin, U.S. Pat. No. 5,584,486, have been invented. Franklin discloses a game in which a player may make a separate jackpot wager. Seven cards are dealt to the player and the dealer. If the player has a predetermined poker hand in his high hand and a predetermined low hand, the player receives a jackpot payout. The hands are then resolved as in conventional Pai Gow Poker.

This bonus ranking system may still be too complicated for some players, however. It can be seen, therefore, that there is a need in the art for a card game based on Pai Gow that provides a bonus without requiring a separate jackpot wager and in which the bonus is paid based on well known five card poker hands.

SUMMARY OF THE INVENTION

A method of playing a casino card game between a banker, who may be a player or, alternatively, a dealer employed by the casino, and at least one player utilizing at least one standard deck of fifty-two cards begins with the player making a single wager. Five cards are dealt to the banker and to each player. The banker arranges the banker's cards into a three-card hand and a two-card hand with the three-card hand outranking the two-card hand according to conventional poker rankings.

The player inspects his or her cards and, if the player has a predetermined five card poker hand, such as a straight flush, the game enters a first phase. The player exposes the player's cards and compares the player's hand to the banker's hand. The player's game terminates and the player wins a predetermined jackpot if the banker does not have a five card hand with an equal or greater poker rank than the player's hand. Otherwise, the player's game terminates and the player loses the player's wager.

Conversely, if the player does not have a straight flush, the game enters a second stage in which the player arranges the player's cards into a three-card hand and a two-card hand, with the three-card hand outranking said two-card hand according to conventional poker rankings. The player's hands are compared to the corresponding banker's hands. The player is rewarded by the banker if both the player's hands outrank the corresponding banker's hands according to conventional poker rankings. A push occurs, and the banker neither rewards nor collects the player's wager, if one of the player's hands outranks the corresponding banker's hand and the remaining banker's hand outranks or ties the remaining player's hand according to conventional poker rankings. If each of the banker's hands outrank or tie the player's hands, the banker collects the player's wager.

It is an object of the present invention to provide a card game based on Pai Gow using a simple ranking system and a simple bonus system that does not require a player to make an additional wager.

DESCRIPTION

Figure 1:
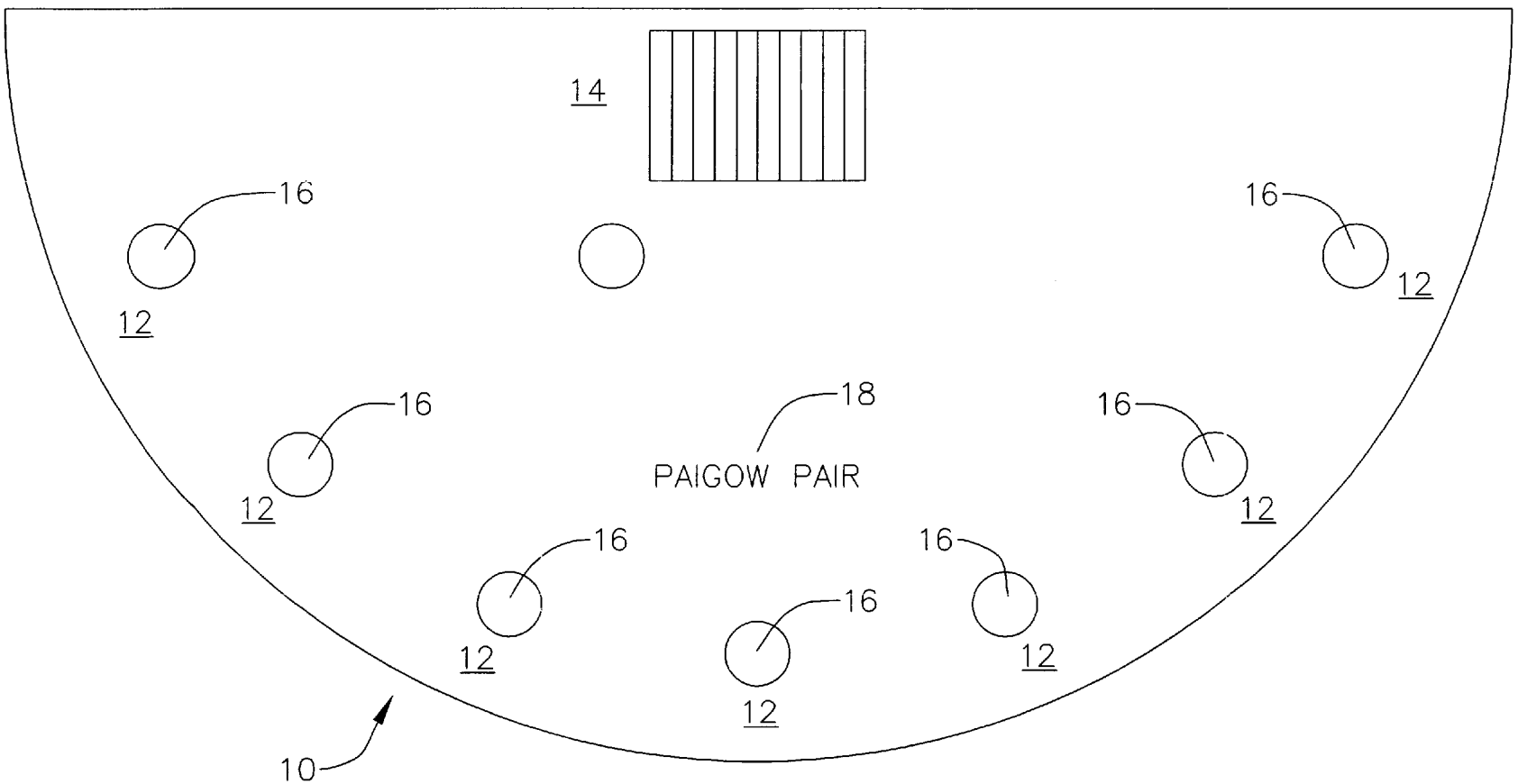
FIG. 1 is a top view of a table layout according to an embodiment of the present invention.

Reference is now made to the figures wherein like parts are referred to by like numerals throughout. Referring to FIG. 1, the present invention is a card game played on a table layout 10. The layout 10 includes a dealer position 14 and a plurality of participant positions 12. The layout 10 optionally includes wagering areas 16 for each participant position 12. The layout 10 may additionally include lettering 18 indicating the game played at the layout 10. The game is played using conventional playing cards. Optionally, a single fifty-two card deck may be used.

Figure 2:
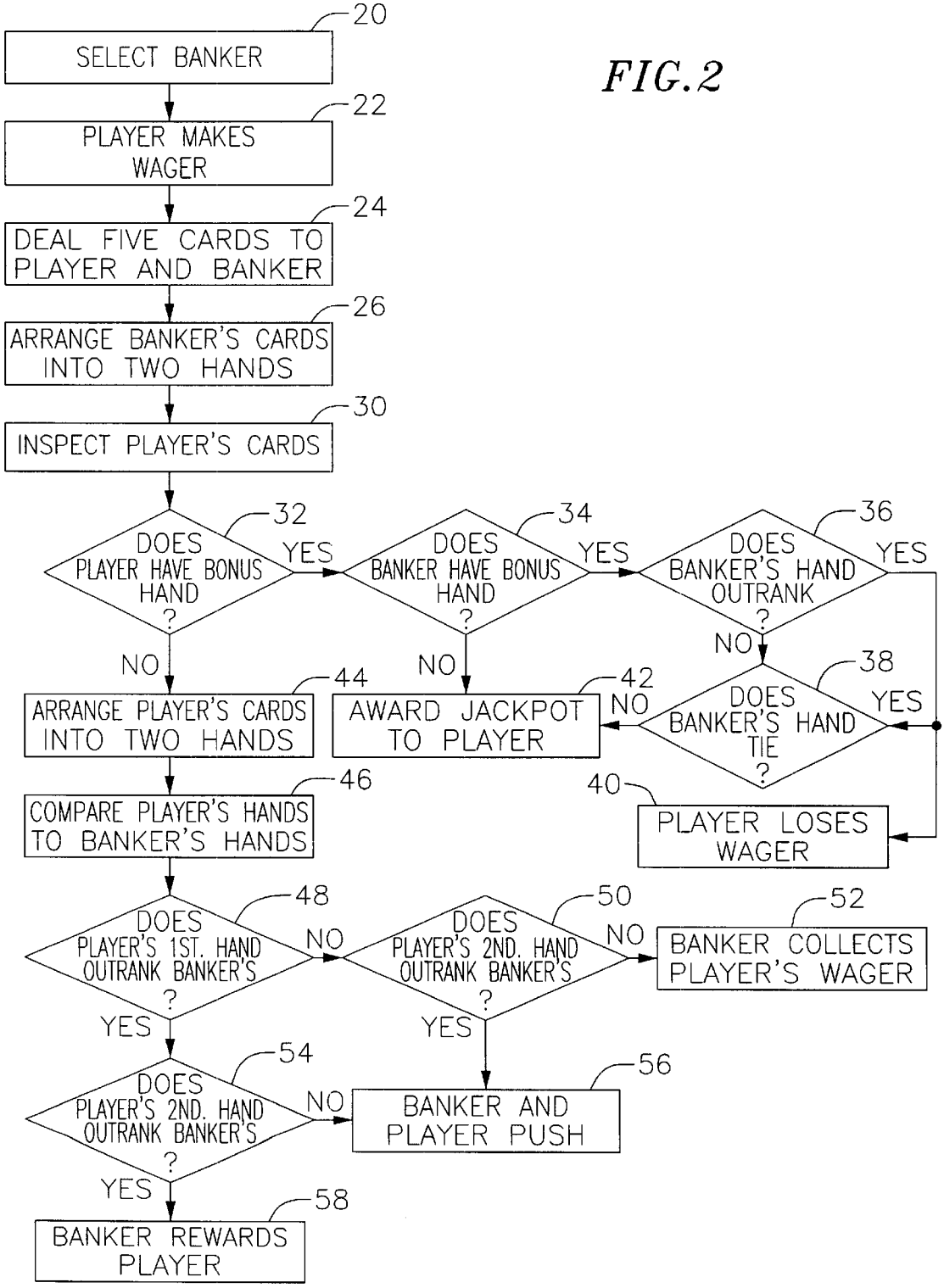
FIG. 2 is a flow chart of the method of the present invention.

With reference to FIG. 2, the game is played between players and a banker. A banker is selected 20 from among the participants including the dealer. In an embodiment of the present invention, the dealer employed by the casino may act as the banker or, alternatively, may act as a player. That is, in such an embodiment, the dealer only acts as the banker if no participant wishes to act as the banker, otherwise, the dealer acts as a player by dealing himself a player hand. As described in more detail below, the role of the banker is to (1) collect and reward wagers by players (including the dealer) and (2) possess the banker hand that is compared to each player hand. Optionally, the dealer offers the bank to the first participant to the dealer's left. If the participant declines to be the banker, the bank is serially offered to the other participants. If no participant selects to act as the banker, the dealer acts as the banker.

Once a banker is selected 20, each player makes 22 a single wager. If a participant is acting as the banker, the dealer also makes 22 a wager. Optionally the dealer must wager 22 the amount wagered by the banker in the immediately preceding game.

The dealer deals 24 five cards to the banker and to each player (including the dealer if a participant is acting as the banker). The banker arranges 26 his five cards into a three-card hand and a two-card hand. Optionally, a rule may be implemented that the three-card hand must outrank the two-card hand according to conventional poker rankings. In an optional embodiment, when the dealer acts as the banker, the dealer arranges 26 the banker's hand according to the following house rules:

(a) For three of a kind of aces, play two of the aces in the three-card hand and the other ace in the two-card hand;

(b) For three of a kind of kings, play two of the kings in the three-card hand and the other king in the two card hand, however, if the hand includes an ace, play the three like cards in the three-card hand and the ace in the two-card hand;

(c) For all other three of a kind, play the three like cards in the three-card hand;

(d) Split all full houses with the three of a kind in the three-card hand and the pair in the two-card hand;

(e) Split all four of a kinds with one pair in each hand;

(f) For two pair, play the higher pair in the three-card hand and the lower pair in the two-card hand;

(g) For one pair, play the pair in the three-card hand;

(h) If a hand contains a three card straight flush, flush, or straight, form a two-card hand with jack or better if possible, otherwise play the highest card in the two-card hand;

(i) If a hand contains none of the above, play the highest card in the three-card hand and the second and third highest cards in the two-card hand.

Each player, including the dealer if a participant is acting as the banker, examines 30 the cards of the player's hand. If the player's hand includes a predetermined five card bonus poker hand 32, such as a straight flush, the player enters a first stage of the game. The player receiving the bonus poker hand compares 34 the player's hand to the banker's hand. The player is rewarded with a jackpot 42 if the banker does not have the predetermined bonus poker hand 34 or if the banker has a lower ranking predetermined poker hand 36. For example, if the predetermined poker hand is a straight flush and the player has 5♢ 6♢ 7♢ 8♢ 9♢0, the player's game is terminated and the player's wager is rewarded with the jackpot if the banker does not have a straight flush or has a straight flush with less than eight high, such as 3♤ 4♤ 5♤ 6♤ 7♤.

Optionally the jackpot may be different depending on the rank of the player's poker hand, e.g. the jackpot may be larger for a royal flush than a lower straight flush.

Conversely, in the example, the player's game is terminated and the player's wager is collected 40 if the banker has a straight flush with greater than nine high such as 7♤ 8♤ 9♤ 10♤ J♤. In the event of a tie 38, various rules may be implemented. For example, (1) the player may win ties; (2) the banker may win ties; or (3) the player may win ties when the house is the banker and lose ties when a participant is the banker. In any event, if a player enters the first stage by obtaining the predetermined poker hand, the player's wager is resolved and the game is terminated in the first stage; that is, the player does not enter the second stage as described below if the player enters the first stage.

If the player does not have a predetermined poker hand 32, the player enters a second stage of the present game. In the second stage, the player arranges 44 the player's hand into a three-card hand and a two-card hand. Optionally, the rules may require that the three-card hand outrank the two-card hand. The player's hands are compared 46 to the corresponding banker's hands. The player is rewarded 58 by the banker if both the player's hands outrank 48, 54 the corresponding banker's hands according to conventional poker rankings. In an optional embodiment, the player is rewarded at even money. Additionally, the house may assess a commission, such as five percent, on all winning wagers. If both of the banker's hands outrank or tie 50 both player's hands, the banker collects the player's wager 52. A push 56 occurs, and the banker neither rewards nor collects the player's wager, if one of the player's hands outranks the corresponding banker's hand and the remaining banker's hand outranks or ties the remaining player's hand according to conventional poker rankings.

In an optional embodiment, three-card hands may be ranked in descending order as shown in Table 1.

TABLE 1

| |
|---|
| Three of a Kind |
| Pair |
| Straight flush (in descending order: A K Q, A 2 3, K Q J, Q J 10, etc.) |
| Flush |
| Straight (in descending order: A K Q, A 2 3, K Q J, Q J 10, etc.) |
| High card |

Likewise, two-card hands may optionally be ranked in descending order as shown in Table 2.

TABLE 2

| |
|---|
| Pair |
| High card |

While certain embodiments of the present invention have been shown and described it is to be understood that the present invention is subject to many modifications and changes without departing from the spirit and scope of the claims presented herein.

I claim:

1. A method of playing a casino card game between a banker and at least one player utilizing at least one standard deck of fifty-two cards, comprising:

the player making a single wager;

dealing five cards to the banker and to each player; and the player examining his five cards and, depending upon the player's five cards, resolving the player's single wager by only one of the following paths:

(a) if the player's five cards form a predetermined poker hand, exposing the player's five cards and comparing the player's five cards to the banker's five cards, said banker rewarding said player based on his wager if the player's five cards comprise in combination a poker hand of greater value than the banker's five card poker hand according to conventional poker rankings, said player losing his wager if the banker's five cards comprise in combination a poker hand of greater value than the player's five card poker hand according to conventional poker rankings, the game terminating for each,player upon resolution of the player's wager; or (b) if the player's five cards do not form a predetermined poker hand, arranging the banker's cards into a three-card hand and a two-card hand, arranging the player's cards into a three-card hand and a two-card hand, and comparing the player's three-card hand to the banker's three-card hand wherein the three-card hand rankings in descending order are three of a kind, pair, straight flush, flush, straight, high card and the player's two-card hand to the banker's two-card hand wherein the two-card hand rankings in descending order are pair and high card, said banker rewarding said player based on his wager if both the player's hands outrank the corresponding banker's hands according to the two-card and three-card hand rankings, the game terminating for each player upon resolution of the player's wager.

2. The method of claim 1 wherein the predetermined poker hand is a straight flush.

3. A method of playing a casino card game between a banker and at least one player utilizing at least one standard deck of fifty-two cards, said game dealt and supervised by a dealer, comprising:

selecting a banker;

the player making a single wager;

the dealer dealing five cards to the banker and to each player; and the player examining his five cards and, depending upon the player's five cards, resolving the player's single wager by only one of the following paths:

(a) if the player's five cards form a predetermined poker hand, exposing the player's five cards and comparing the player's five cards to the banker's five cards, said banker rewarding said player based on his wager if the player's five cards comprise in combination a poker hand of greater value than the banker's five card poker hand according to conventional poker rankings, said player losing his wager if the banker's five cards comprise in combination a poker hand of greater value than the player's five card poker hand according to conventional poker rankings, said player tying if the banker's five cards comprise a poker hand of equal value to the player's five card poker hand according to conventional poker rankings, said ties resolved in favor of the player if the dealer is the banker and in favor of the banker if the dealer is not the banker, the game terminating for each player upon resolution of the player's wager; or (b) if the player's five cards do not form a predetermined poker hand, arranging the banker's cards into a three-card hand and a two-card hand, arranging the layer's cards into a three-card hand and a two-card hand, and comparing the player's three-card hand to the banker's three-card hand wherein the three-card hand rankings in descending order are three of a kind, pair, straight flush, flush, straight, high card and the player's two-card hand to the banker's two-card hand wherein the two-card hand rankings in descending order are pair and high card, said banker rewarding said player based on his wager if both the player's hands outrank the corresponding banker's hands according to the two-card and three-card hand rankings, the game terminating for each player upon resolution of the player's wager.

4. The method of claim 3, wherein the predetermined bonus poker hand is a straight flush.

5. A method of playing a casino card game between a banker and at least one player utilizing at least one standard deck of fifty-two cards, comprising:

the player making a single wager;

dealing five cards to the banker and to each player; and the player examining his five cards and, depending upon the player's five cards, resolving the player's single wager by only one of the following paths:

(a) if the player's five cards form a straight flush, exposing the player's five cards and comparing the player's five cards to the banker's five cards, said banker rewarding said player based on his wager if the player's straight flush is of greater value than the banker's five card poker hand according to conventional poker rankings, said player losing his wager if the banker's five cards comprise in combination a poker hand of equal or greater value than the player's straight flush according to conventional poker rankings, the game terminating for each player upon resolution of the player's wager; or (b) if the player's five cards do not form a straight flush, arranging the banker's cards into a three-card hand and a two-card hand wherein the three-card hand outranks the two-card hand according to conventional poker rankings even if the banker's cards form a straight flush, arranging the player's cards into a three-card hand and a two-card hand wherein the three-card hand outranks the two-card hand according to conventional poker rankings, and comparing the player's three-card hand to the banker's three-card hand wherein the three-card hand rankings in descending order are three of a kind, pair, straight flush, flush, straight, high card and the player's two-card hand to the banker's two-card hand wherein the two-card hand rankings in descending order are pair and high card, said banker rewarding said player based on his wager if both the player's hands outrank the corresponding banker's hands according to the two-card and three-card hand rankings, said banker collecting said wager if both the banker's hands outrank or tie the corresponding player's hands according to the two-card and three-card hand rankings, said banker neither collecting or rewarding said wager if only one of the player's hands outranks a corresponding banker hand according to the two-card and three-card hand rankings, the game terminating for each player upon resolution of the player's wager.

* * * * *